US005281084A

United States Patent [19]

Noe et al.

[11] Patent Number: 5,281,084

[45] Date of Patent: Jan. 25, 1994

[54] CURVED FILM COOLING HOLES FOR GAS TURBINE ENGINE VANES

[75] Inventors: Mark E. Noe, Cincinnati; Robert Proctor, West Chester, both of Ohio

[73] Assignee: General Electric Company, Cincinnati, Ohio

[21] Appl. No.: 552,281

[22] Filed: Jul. 13, 1990

[51] Int. Cl.[5] ..... F01D 9/04

[52] U.S. Cl. ..... 415/115

[58] Field of Search ..... 415/115, 116; 416/96 R, 416/97 R

[56] References Cited

U.S. PATENT DOCUMENTS

| | | | |
|---|---|---|---|
| 3,528,751 | 9/1970 | Quinones et al. | 416/96 R |
| 3,713,750 | 1/1973 | Williams . | |
| 3,844,677 | 10/1974 | Evans et al. . | |
| 3,883,268 | 5/1975 | Evans et al. . | |
| 3,891,163 | 6/1975 | Wilkerson et al. . | |
| 4,025,226 | 5/1977 | Hovan . | |
| 4,118,146 | 10/1978 | Dierberger | 415/115 |
| 4,153,386 | 5/1979 | Leogrande et al. . | |
| 4,183,716 | 1/1980 | Takahara et al. . | |
| 4,293,280 | 10/1981 | Yim . | |
| 4,297,077 | 10/1981 | Durgin et al. . | |
| 4,312,624 | 1/1982 | Steinbauer, Jr. et al. . | |
| 4,314,442 | 2/1982 | Rice . | |
| 4,347,037 | 8/1982 | Corrigan | 416/97 A |
| 4,384,823 | 5/1983 | Graham et al. | 416/1 |
| 4,403,917 | 9/1983 | Laffitte et al. . | |
| 4,427,338 | 1/1984 | Furst . | |
| 4,507,051 | 3/1985 | Lesgourgues et al. . | |
| 4,542,867 | 9/1985 | Memmen . | |
| 4,565,490 | 1/1986 | Rice . | |
| 4,604,031 | 8/1986 | Moss et al. | 415/115 |
| 4,616,976 | 10/1986 | Lings et al. . | |
| 4,653,983 | 3/1987 | Vehr | 415/115 |
| 4,684,323 | 8/1987 | Field | 416/97 R |
| 4,705,455 | 11/1987 | Sahm et al. | 416/97 R |
| 4,738,588 | 4/1988 | Field | 416/97 R |
| 4,741,667 | 5/1988 | Price et al. | 415/191 |
| 4,767,261 | 8/1988 | Godfrey et al. . | |
| 4,767,268 | 8/1988 | Auxier et al. . | |
| 4,790,782 | 12/1988 | McCormick . | |

FOREIGN PATENT DOCUMENTS

| | | | |
|---|---|---|---|
| 0079285 | 5/1983 | European Pat. Off. . | |
| 0182302 | 9/1985 | Japan | 416/97 R |
| 0032103 | 2/1988 | Japan | 416/96 R |
| 2184492A | 6/1987 | United Kingdom . | |

OTHER PUBLICATIONS

S. Stephen Papell et al.; "Influence of Coolant Tube Curvature on Film Cooling Effectiveness as Detected by Infrared Imagery"; NASA Technical Paper No. 1546; 1979; pp. 3–16.

*Primary Examiner*—Edward K. Look
*Assistant Examiner*—Christopher Verdier
*Attorney, Agent, or Firm*—Jerome C. Squillaro; James P. Davidson

[57] ABSTRACT

A method and apparatus for film cooling of an aerodynamically shaped airfoil uses a plurality of curved slots extending through the airfoil in an area upstream of the high curvature region of the airfoil, i.e., in an area of low Mach number of the gas stream passing over the airfoil surface. The curved slots are configured to inject cooling air at an angle of about 16.5 degrees. The cooling air is injected at a blowing ratio in excess of 1.0 and yet is effective to form a film on the vane surface.

9 Claims, 2 Drawing Sheets

CURVED FILM COOLING HOLES FOR GAS TURBINE ENGINE VANES

The present invention relates to vanes for gas turbine engines and, more particularly, to vanes having hollow airfoil sections with vent holes for cooling.

BACKGROUND OF THE INVENTION

The high temperature of inlet gas stream air entering high pressure turbine nozzles and flowing over outer surfaces of individual vanes of the nozzles in a gas turbine engine has required cooling of the vane airfoil sections in order to maintain vane temperatures within the present material capability. Cooling is commonly provided by forming the vanes as hollow airfoils and providing vent holes from the hollow interior through which a cooling gas, typically air, is forced. The gas desirably forms a film over at least a portion of the airfoil surface and thereby cools or at least insulates such surface. The film cooling injection location is extremely important on the suction side (convex surface) of the airfoil where the hot gas stream can become supersonic. Performance considerations have driven film cooling to be introduced on the airfoil surface at locations where the hot gas stream has a low velocity and near the leading edge of the airfoil section. The selection of cooling film injection locations is a trade-off between performance and cooling of the airfoil. Performance losses are directly proportional to the square of the main stream Mach number at the injection locations. Therefore, the impact on engine performance is significantly different when comparing performance when coolant is injected in a region where the Mach number is about 0.3 as opposed to injection in a region where the Mach number is about 1.0. However, when injection occurs in a low Mach number region, the cooling film may degrade to a point of being ineffective prior to reaching the vane trailing edge. In order to compensate for such degradation, it is necessary to increase the flow of coolant, but such increased flow adversely affects the temperature profile out of the combustor and adversely affects engine performance. Accordingly, coolant injection is often a trade-off of performance against cooling and component life.

With some high curvature airfoil sections, the gas film or vent holes are oriented angularly so as to reduce the gas film injection angle. The reduced angle improves the ability of the film to flow along the airfoil surface. If the film does not flow along the surface, i.e., if it is dissipated in the gas stream, then cooling is ineffective. Film blow-off occurs if the strength of the injected coolant relative to the strength of the gas stream, i.e., the blowing rate, is incorrect for the coolant injection angle. It has also been proposed to turn the cooling gas through a large angle, e.g., between 135 and 165 degrees, using a curved admission tube before injecting the cooling gas at an angle of between about 15 and 45 degrees with respect to the airfoil surface, to try to force the film to remain on the vane surface over greater distances. However, this arrangement has been applied to airfoils having relatively continuously curved suction sides which do not introduce rapid velocity changes. More particularly, this proposed arrangement has been demonstrated to be effective only for blowing rates of between about 0.37 and 0.70. For blowing rates above 0.70, the curved tube was found to be less effective in film cooling than straight tube injection. This above approach is discussed in detail in NASA Technical Paper 1546 published in 1979 and entitled "Influence of Coolant Tube Curvature in Film Cooling Effectiveness as Detected by Infrared Imagery", by Papell, Graham, and Cageao. In general, it is believed that blowing ratios greater than 1.1 are less effective in film cooling.

The development of blunt leading edge airfoils creates more severe film cooling requirements. With such airfoils, a high curvature section exists immediately downstream of the normal film injection point. Conventional injection processes are ineffective to maintain the cooling film on the airfoil surface over such high curvature regions. Furthermore, the velocity of the high temperature gases over high curvature regions approaches supersonic velocities and contributes to the degradation of the cooling film due to large free stream turbulence.

SUMMARY OF THE INVENTION

It is an object of the present invention to provide a method and apparatus for overcoming the above and other disadvantages associated with film cooling of blunt airfoils in gas turbine engines.

It is another object to provide a method and apparatus for cooling of blunt airfoils which increases the effectiveness of film cooling.

In one form of the invention, there is provided a vane for a gas turbine engine nozzle which has an airfoil section with a broad, blunt leading edge having a region of high curvature transitioning from the leading edge to a convex shaped suction surface. A plurality of vent holes are formed in the airfoil for conveying a cooling gas from the hollow interior of the airfoil to the outer surface thereof. At least some of the vent holes are located in the broad leading edge of the airfoil immediately upstream of the high curvature region such that cooling gas can be injected where the velocity of the high temperature gas stream flowing along the vane is relatively low. These vent holes are formed with an arcuate shape through the airfoil wall so that the injection angle of the cooling gas is less than 25 degrees and preferably about 16 degrees. The arcuate or curved vent holes serve to direct the cooling gas downward along the airfoil surface and concurrently aid in convection cooling of the airfoil by extending the length of the holes through the airfoil wall. In addition, the blowing ratio can be increased to values greater than 1.0 to obtain effective cooling.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
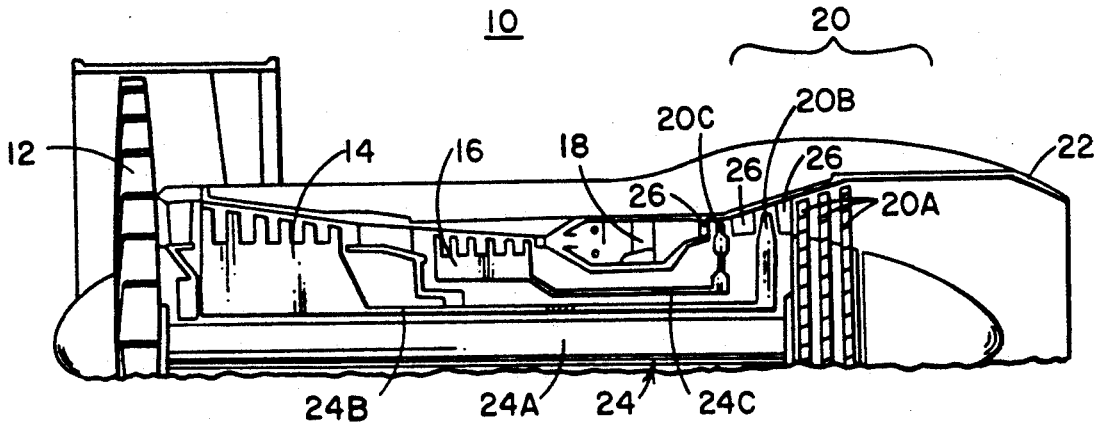
FIG. 1 (PRIOR ART)
FIG. 1 is a simplified partial cross-sectional view of an exemplary gas turbine engine illustrating the location of the turbine vanes to be cooled.

FIG. 1 illustrates a triple spool front fan high-bypass ratio ducted fan gas turbine engine 10 with which the present invention may be used. The engine 10 includes a ducted fan 12, intermediate and high pressure compressor sections 14 and 16, respectively, a combustion chamber 18, a turbine stage 20, and an exhaust nozzle 22. The turbine stage 20 may be divided into high, low, and intermediate sections for providing power to the fan 12 and compressor sections 14, 16 through corresponding elements of a central shaft 24. Shaft section 24A connects the final turbine disks 20A to fan 12, shaft section 24B connects turbine disk 20B to compressor section 14, and shaft section 24C connects turbine disk 20C to compressor section 16. Air compressed by fan 12 and the compressor sections 14, 16 is mixed with fuel and combusted in combustion chamber 18. The combustion products expand through the turbine stage 20 and are exhausted through nozzle 22. Propulsive thrust is provided by air moved outside the engine by the fan 12 coupled with some thrust provided by exhaust from the nozzle 22.

Figure 2:
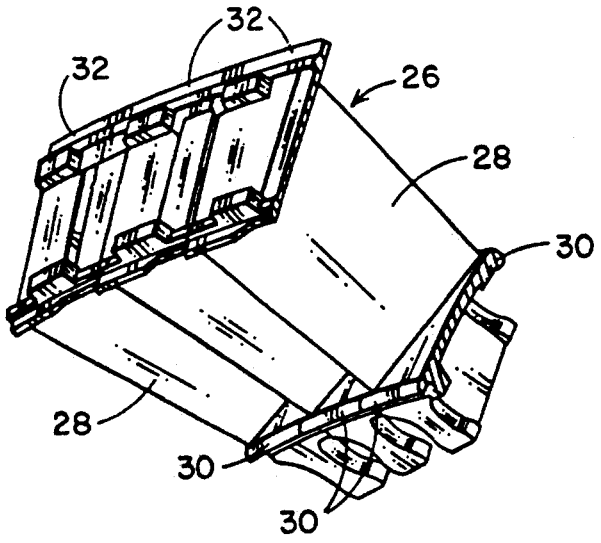
FIG. 2 (PRIOR ART)
FIG. 2 is a simplified perspective view of a turbine vane of the prior art.
Figure 3:
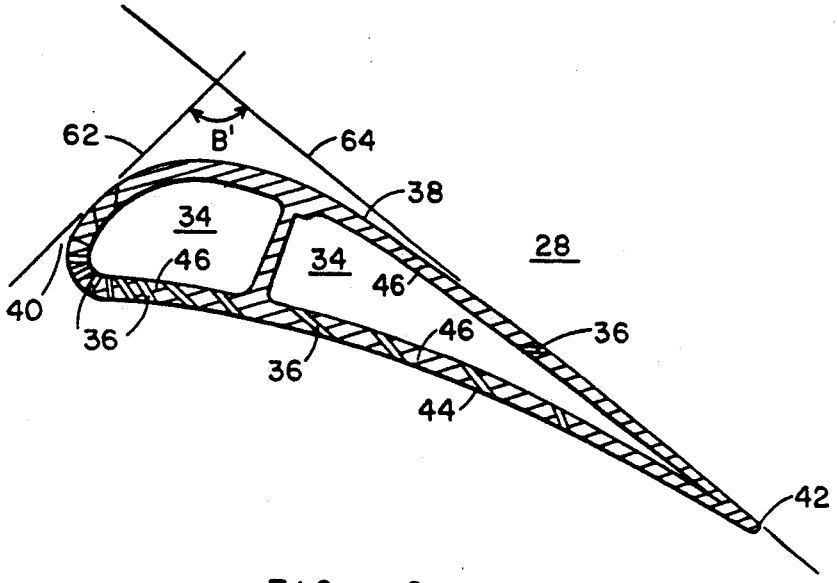
FIG. 3 (PRIOR ART)
FIG. 3 is a cross-sectional view taken through a turbine vane of the type shown in FIG. 2.

The turbine stage 20 includes a plurality of annular rows of circumferentially spaced and radially extending nozzle guide vanes 26. Referring to FIG. 2, each vane 26 comprises an airfoil 28 having a radially inner platform 30 and a radially outer platform 32. The platforms 30 and 32 of adjacent vanes 26 cooperate with each other as shown in FIG. 2 to define radially inner and outer boundaries of a portion of the gas flow path through the turbine stage 20. The airfoils 28 serve to direct the high temperature gas stream from the combustion chamber 18 onto annular rows of rotor blades coupled to respective sections of shaft 24. FIG. 3 is a cross-sectional view taken through one of the airfoils 28 and illustrates a prior art arrangement of cooling air holes 36 between a hollow interior 34 and selected areas of the outer surface of the airfoil. Cooling air delivered to the hollow interior 34 of the airfoil and exhausted through the vent holes 36 flows along the outer surface of the airfoil forming a film which cools the outer surface and insulates it from the high temperature combustion gases. The cooling air is generally supplied by tapping it from air passing through the compressor section 16 in a manner well known in the art.

The airfoil illustrated in cross-section in FIG. 3 represents a typical prior art nozzle blade in which the airfoil has a relatively continuous arc of curvature over its convex or suction surface 38 extending from a relatively aerodynamic leading edge to the trailing edge 42. The shape of the concave or pressure surface 44 is approximately the same as the suction surface 38. With such smooth, continuously curved surfaces, it is relatively easy to provide film cooling through use of substantially straight holes 36 passing through the walls 46. Some of these holes 36 may be angularly oriented so that the cooling air is directed in the direction of flow of the hot gas stream.

Film cooling is not primarily intended as protection of the surface at the point of injection but rather as protection of the surface at a region downstream of the injection location. The injection of a cooling gas (air) into the boundary layer with film cooling may be considered to produce an insulating layer or film between the surface to be protected and the hot gas stream flowing over the surface. The film layer also acts as a heat sink to lower the mean temperature in the boundary layer adjacent the surface. As described above, there is a trade-off between engine performance and cooling air injection. If sufficient cooling air is not injected onto the vane surface, the coolant will be dissipated too quickly and will not be effective to protect the vane surface. If the cooling air is injected at too high a rate, blow-off can occur. This phenomenon occurs when the cooling flow drives away from the vane surface because of its strength thus allowing the hot gas stream to remain in contact with the surface, i.e., no insulation layer is formed. Blowing ratio is a measure of the strength of the injected cooling gas or air relative to the strength of the hot gas stream. High blowing ratios are characteristic of blow-off. In general, a blowing ratio in the order of 1.1 is characteristic of a coolant injection rate which is ineffective, i.e., the coolant does not form a surface film and degrades rapidly. Turbulence at the surface of the airfoil due to abrupt shape (curvature) change also contributes to such film degradation.

Studies have shown that improvement in film cooling can be somewhat realized by increasing the flow of cooling air. However, it is generally accepted that a blowing ratio (which compares the mass flow per unit area of cooling air to the mass flow per unit area of hot gases) cannot exceed about 1.0. The aforementioned NASA Technical Paper 1546 compared the effectiveness of curved coolant injection tubes to straight tubes and found that at blowing ratios above 0.70, the effectiveness of curved coolant injection decreased to a point where it became less effective than straight tube injection. This, it is generally believed that film cooling is not effective at blowing ratios above 1.0. More particularly, at blowing ratios of about 1.1, the velocity of the cooling air is sufficiently strong to detach itself from the surface and blow into the hot gas stream.

Figure 4:
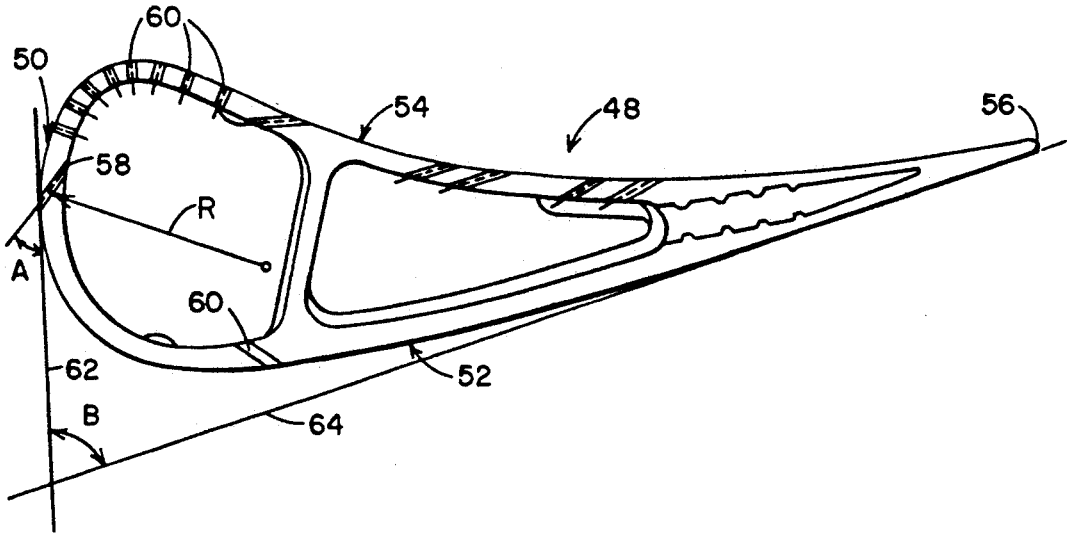
FIG. 4 is a cross-sectional view taken through a turbine vane having a blunt leading edge and incorporating film cooling in accordance with the present invention.

Turning now to FIG. 4, there is shown a cross-sectional view of a more recent design for a nozzle vane. The vane, indicated generally at 48, has a broad, blunt leading edge 50, a convex shaped suction surface 52, a concave shaped pressure surface 54, and a trailing edge 56. While this vane airfoil configuration is advantageous in directing the combustion gases onto the rotatable rotor blades in the turbine stage 20, it does create additional cooling difficulties due to the high rate of change of curvature in transitioning from leading edge 50 to surface 52. The velocity of the combustion gases at and across the leading edge 50 tends to be relatively low while the velocity across the suction surface 52 may become supersonic. Accordingly, there is a significant turbulence effect as the hot gas stream accelerates from the leading edge to the suction surface.

Applicants have found that film cooling can be made effective notwithstanding the broad leading edge configuration and without adversely affecting performance of the nozzle by forming a plurality of vent holes 58 in the low Mach number region of the leading edge 50. While the set of holes 58 may be arranged in various selected patterns, applicants prefer that the holes 58 are formed as a radially aligned row of curved or arcuate slots through the leading edge wall. Applicants have found that an arcuately shaped or curved vent hole formed with a radius R of about 0.675 inches and an injection angle A of about 16.5 degrees, formed by the intersection of a line extending from vent hole 58 across a line tangent to blunt leading edge 50, is not only effective to establish a cooling or insulative film but provides improved performance over straight vent holes, in contrast to the aforementioned NASA report, with a blowing ratio in the order of 1.2. Still further, the arcuately shaped vent holes 58 provide more effective convective cooling since the effective length of the holes 58 is longer. It is believed that an injection angle up to 25 degrees can be used with the curved cooling holes and with a blowing ratio of about 1.2 and still provide effective film cooling. It may be noted that straight vent holes 60 may be utilized for film cooling in other areas of the airfoil.

In a preferred embodiment, the cooling air vent holes 58 are formed as slots having a rectangular cross-section of about 24 mils in width in the axial or gas stream flow direction and a breadth of 55 mils in the radial direction. Center to center spacing of the slots or holes 58 is about 0.1 inches in the radial direction so that the spacing between adjacent slots is about 45 mils. The curved slots 58 exit at an angle of about 16.5 degrees (cooling air injection angle of 16.5 degrees). The slots 58 are desirably formed using electric discharge machining (EDM) and a spaced, rectangular, EDM electrode.

The curved holes 58 provide a significant reduction in cooling air injection angle which can be reduced below the preferred 16.5 degrees allowing for improved film cooling and coverage by the film for high blowing ratio (greater than 1.0) applications. More radial surface of the airfoil is covered by the rectangular slot configuration of the holes 58 than possible with conventional circular holes. The injection of the coolant in the low Mach number region of the airfoil at the leading edge establishes a film of sufficient quality to effectively cool the entire suction side of the airfoil. The curved slots 58 provide more effective convective cooling in the leading edge region of the airfoil.

The degree of curvature in transitioning from the leading edge 50 to the convex suction surface 52 can be appreciated by reference to the included angle B defined by a line 62 tangent to one of the arcuate holes 58 and a line 64 tangent to the trailing edge 56. In the prior art vane airfoils such as that shown in FIG. 3 with the same tangent lines, the included angle B' is obtuse, typically being greater than 125 degrees. In the vane of FIG. 4, the included angle B is acute and typically about 80 degrees.

While other cooling air injection holes, indicated generally at 60, have not been discussed herein, it will be appreciated that the airfoil includes such other cooling air holes and that such other holes may be formed and positioned in a manner similar to the prior art. The forming and positioning of such other holes 60 is not significantly different since such other holes are positioned downstream of the high curvature region and below the blunt leading edge 50.

What has been disclosed is an improved film cooling method and apparatus for a blunt leading edge airfoil. While the invention has been described in what is presently considered to be a preferred embodiment, various modifications and improvements will become apparent to those skilled in the art. It is intended therefore that the invention not be limited to the specific embodiment but be interpreted within the full spirit and scope of the appended claims.

What is claimed is:

1. A vane for a gas turbine engine, comprising:

an airfoil section having a generally convex suction surface terminating in a trailing edge of the airfoil section, a generally concave pressure surface opposite the suction surface and coupled thereto at the trailing edge, the airfoil section further having a relatively blunt leading edge coupling the suction surface to the pressure surface through a transition region with a high curvature, an enclosed chamber being defined by said leading edge, said pressure surface and said suction surface within said airfoil section;

a plurality of vent holes penetrating said airfoil section for passing a cooling fluid from within said chamber to said surface of said airfoil, said vent holes comprising arcuate passages extending through said leading edge adjacent said high curvature transition region for directing cooling fluid toward said suction surface at an injection angle less than about 25 degrees, said cooling fluid having a mass flow rate such that the blowing ratio at the vane surface is greater than 1.0.

2. The vane as recited in claim 1 wherein the curved vent holes have a radius of curvature of about 0.675 inches.

3. The vane as recited in claim 1 wherein the injection angle is about 16.5 degrees.

4. The vane as recited in claim 1 wherein the blowing ratio is about 1.2.

5. The vane as recited in claim 1 wherein a line tangent to one of said vent holes and a line tangent to said trailing edge of said vane form an angle therebetween of less than 90 degrees.

6. A method of cooling a vane in a gas turbine engine, the vane having an airfoil section exposed to a stream of high temperature combustion gases in the gas turbine engine and the airfoil section including a relatively broad and blunt leading edge, a convex shaped suction surface, a set of arcuate cooling air injection holes in the leading edge of the airfoil section upstream of the suction surface, and a chamber within the airfoil section communicating with the cooling air injection holes, the method comprising the steps of:

injecting cooling air from the chamber through the cooling air injection holes onto the relatively broad and blunt leading edge with an injection angle of less than about 25 degrees and establishing a blowing ratio greater than about 1.0 in response to the injecting step.

7. The method of claim 6 and further including the step of forming the arcuate shaped air injection holes with a radius of curvature of about 0.675 inches.

8. The method of claim 6 wherein the injecting step comprises injecting cooling air at an injection angle of about 16.5 degrees.

9. The method of claim 6 wherein the step of adjustably establishing a blowing ratio comprises the step of establishing a blowing ratio of about 1.2.

* * * * *